343-700 MS AU 251 EX
7/10/84 OR 4,459,594

United States Patent [19]

Hall et al.

[11] Patent Number: 4,459,594

[45] Date of Patent: Jul. 10, 1984

[54] STRIPLINE ANTENNAS

[75] Inventors: Peter S. Hall, Shrivenham; Colin Wood, Havant, both of England

[73] Assignee: The Secretary of State for Defence in Her Britannic Majesty's Government of the United Kingdom of Great Britain and Northern Ireland, London, England

[21] Appl. No.: 351,099

[22] Filed: Feb. 23, 1982

[30] Foreign Application Priority Data

Mar. 4, 1981 [GB] United Kingdom ..... 8106781

[51] Int. Cl.[3] ..... H01Q 1/38

[52] U.S. Cl. ..... 343/700 MS; 343/731

[58] Field of Search ..... 343/700 MS, 806, 846, 343/854, 731, 708

[56] References Cited

U.S. PATENT DOCUMENTS 3,231,894 1/1966 Nagai ..... 343/806
4,021,810 5/1977 Urpo et al. ..... 343/846
4,180,817 12/1979 Sanford ..... 343/700 MS
4,260,988 4/1981 Yanagisawa et al. ..... 343/700 MS
4,335,385 6/1982 Hall ..... 343/700 MS

FOREIGN PATENT DOCUMENTS 798821 7/1958 United Kingdom ..... 343/708

*Primary Examiner*—Eli Lieberman
*Attorney, Agent, or Firm*—Pollock, Vande Sande and Priddy

[57] ABSTRACT

In a prior form of stripline antenna, the strip turns through successive right-angle corners to form successive multi-cornered cells in which the lengths of the longitudinal and transverse strip sections are such that the summed radiation from each cell radiates in the same direction and with the same polarization direction. In the present disclosure, the distribution of radiated power along the array is varied, e.g. to maximize it at the center, by varying the absolute lengths of these strip sections as between cells while maintaining their required relationships, e.g. by progressively increasing these lengths towards the center of the array in order to increase the radiated power accordingly. This compares with the previously known method, viz varying the strip width.

3 Claims, 11 Drawing Figures

STRIPLINE ANTENNAS

This invention relates to stripline antennas, in particular to stripline antenna arrays.

In prior copending Hall U.S. application Ser. No. 55,259 filed July 6, 1979, for "Stripline Antennas" now U.S. Pat. No. 4,335,385 issued June 5, 1982, there are described forms of stripline antenna arrays in which a conducting strip on an insulating substrate having a conducting backing turns through successive quartets of right-angle corners, each corner radiating with diagonal polarization, to form a succession of four-cornered cells whereof corresponding corners radiate in phase and the summed radiation from each quartet has the same polarization direction. The polarisation direction depends on the lengths of the transverse and longitudinal sections of the strip in each quartet in relation to the operating wavelength in the strip, and the said application Ser. No. 55,259 describes arrays in which these lengths produce vertical, horizontal or circular polarization respectively, all in a direction normal to the plane of the array, ie the so-called broadside radiation.

In a copending U.S. application of even data and identical title by the present applicants Ser. No. 351,097, there is described a stripline antenna array comprising:

a strip of conducting material on an insulating substrate having a conducting backing;

said strip turning through successive right-angle corners to form a plurality of similar cells each notionally constituted by three equispaced transverse sections of the strip extending at right angles from the longitudinal axis of the array, the central transverse section extending both sides of said axis, and connected at their outward extremities by longitudinal sections of the strip to thereby provide six potential right-angle corner sites in each cell;

the lengths of the transverse sections extending either side of said axis, the length of said longitudinal sections, and the strip-length between successive cells being such, in relation to the operating wavelength in the strip (said transverse section lengths either one side of said axis, and said strip-length between successive cells, being reducible to zero) that when connected to a source of the operating frequency and operated in a travelling wave mode, the summed radiation from the actual right-angle corners in each cell has the same given polarization direction at a given angle to said longitudinal array axis in a longitudinal plane normal to the array plane and containing said array axis;

said polarization direction being other than transverse, axial or circular at an angle of 90° to the array axis in said longitudinal plane.

The exclusion in the final sub-paragraph above results from the disclosure of such arrays having these particular characteristics, in the aforementioned U.S. application Ser. No. 55,259, they being particular examples of a newly-discovered general relationship which is the subject of U.S. application No. 351,097.

In the application Ser. No. 55,259 there is described, with reference to FIG. 5 thereof, a system for varying the distribution of power radiated across the aperture constituted by such an array, in which the strip-width is made to increase progressively towards the center of the aperture so that more power is radiated from the center. The present invention provides a stripline antenna array in which the power distribution is varied by an alternative arrangement.

According to the present invention there is provided a stripline antenna array comprising:

a strip of conducting material on an insulating substrate having a conducting backing;

said strip turning through successive right-angle corners to form a plurality of similar cells each notionally constituted by three equispaced transverse sections of the strip extending at right angles from the longitudinal axis of the array, the central transverse section extending both sides of said axis, and connected at their outward extremities by longitudinal sections of the strip to thereby provide six potential right-angle corner sites in each cell;

the lengths of the transverse sections extending either side of said axis, the length of said longitudinal sections, and the strip-length between successive cells being such in relation to the operating wavelength in the strip (said transverse section lengths either one side of said axis, and said strip-length between successive cells, being reducible to zero) that when connected to a source of the operating frequency and operated in a travelling wave mode, the summed radiation from the actual right-angle corners in each cell has the same given polarization direction at a given angle to said longitudinal array axis in a longitudinal plane normal to the array plane and containing said array axis;

wherein the lengths of the transverse and longitudinal sections in each separate cell differ, as between cells, in such a manner as to produce a required non-uniform power distribution across the aperture constituted by the array. Normally said lengths are made to increase progressively towards the center of the array, thereby to increase the power distribution similarly.

It will be seen that the exclusion referred to above in copending application Ser. No. 351,097, does not apply to the present application.

The present invention may provide an array as aforesaid wherein the lengths of the transverse sections, as between cells, satisfy equations (15) or (16) hereinafter in relation to the required power distribution.

To enable the nature of the present invention to be more readily understood, attention is directed by way of example to FIG. 11 of the accompanying drawings, which is a plan view of an array embodying the present invention.

In describing the present invention, reference will be made to some of the equations derived in application Ser. No. 351,097 for relating the lengths of the strip sections in each cell and between adjacent cells to each other and to the operating wavelength in the strip. For that reason, the description in application Ser. No. 351,097 will first be repeated (within quotation marks) with reference to FIGS. 1–10 of the accompanying drawings, followed by a description of the present invention with reference to FIG. 11, wherein.

Figure 7:
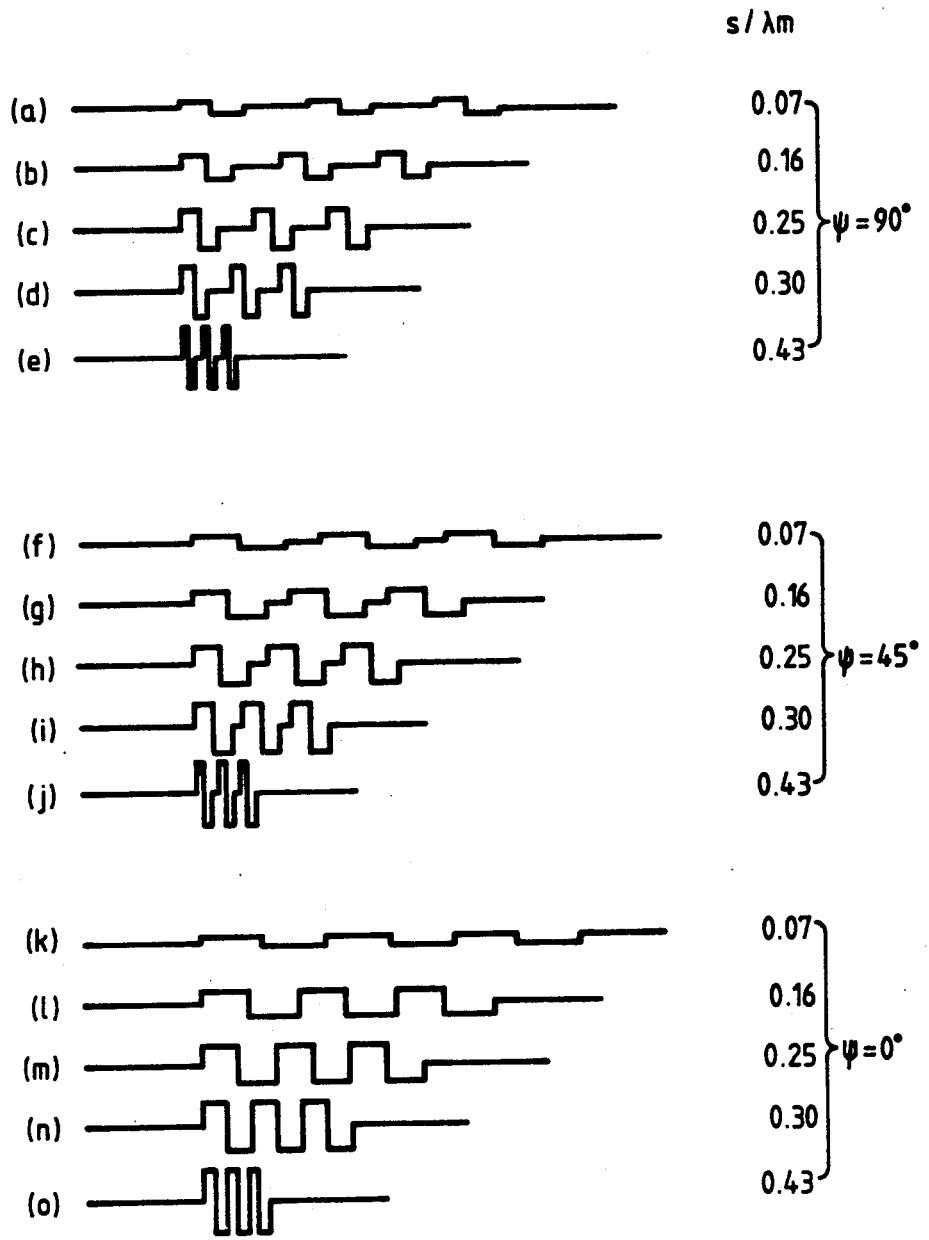

FIGS. 7(*a*) to (*o*) are simplified plan views of arrays having different values of $\psi$ and s (as hereinafter defined).

Figure 8:
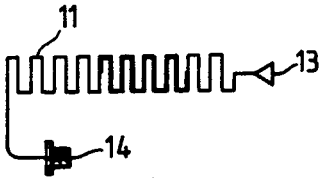

FIG. 8 is a plan view of a specific embodiment of the invention of application Ser. No. 351,097.

Figure 9:
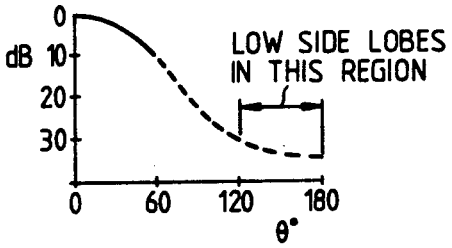
Figure 10:
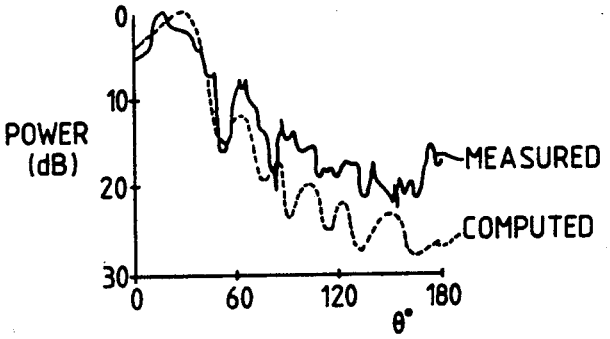

FIGS. 9 and 10 are curves showing respectively the desired and obtained coverage is the $\theta$ plane of the embodiment of FIG. 8.

Figure 11:
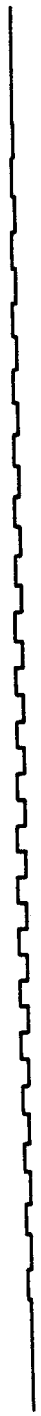

FIG. 11 is a plan view, drawn to scale, of an array embodying the present invention.

Figure 1:
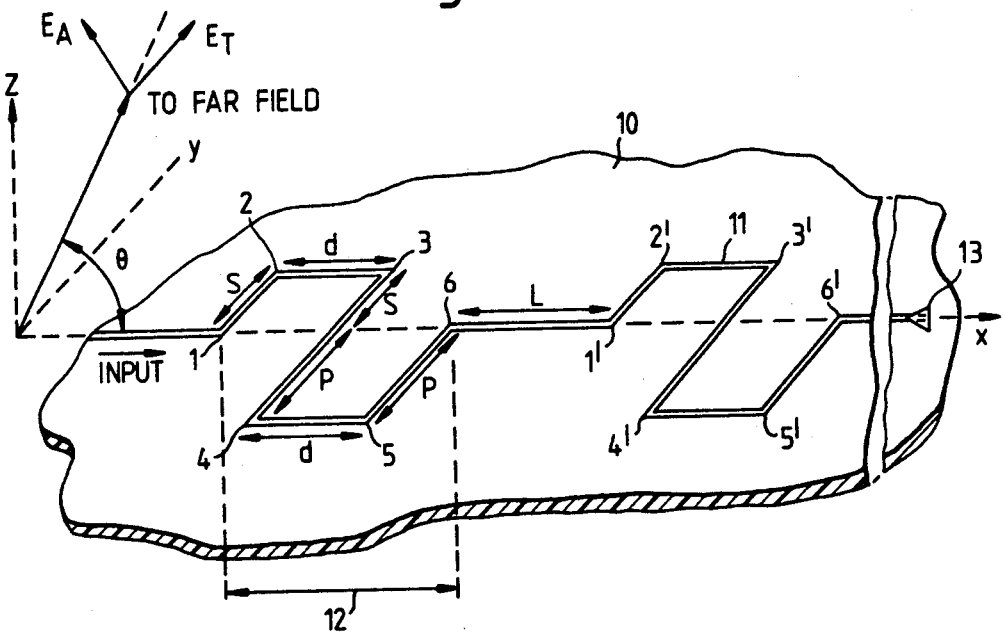
FIG. 1 is a perspective view of two cells of a stripline antenna array embodying the companion invention.

"Referring to FIG. 1, a dielectric sheet 10, originally metal-coated on both faces, has one face etched to form a strip-line 11, leaving the other face to act as a ground-plane (not shown). Starting from the longitudinal axis x of the resulting microstrip array, the strip 11 turns through six successive right-angle corners 1–6 to form a cell constituted by three equispaced transverse sections extending from the axis x, the first section being of length s, the second section extending back across axis x and being of length s+p, and the third section being of length p, whose outward extremities are connected by two sections of length d. This cell, whose extent is indicated by arrow 12, is joined to a succeeding similar cell having corners 1'–6' by a length of strip L, and the complete array, comprising a relatively large number of such cells, is terminated by a matched load 13.

As explained in the aforesaid application Ser. No. 55,259, the radiation from such right-angle corners is predominantly diagonal, and its equivalent circuit can be represented by the radiation conductance in parallel with a capacitative component. To reduce the latter component, the corners may be truncated as described therein.

Each cell shown in FIG. 1 can be considered as having a diagonally polarized magnetic dipole source at each right-angle corner, the dipoles being fed in phase progression to form a travelling-wave array. The field in the plane of the array length only will be considered, ie the x-z or $\theta$ plane in FIG. 1, where z is normal to the plane of the array. Thus, for example, the path-difference from sources 1 and 2 to a far-field point is zero. It can then be shown that the far-field components radiated in the $\theta$ (ie x-z) plane are $$E_T(\theta) = \frac{-4E}{\sqrt{2}} \sin\theta e^{-j\frac{2s+d}{2}\beta + j\frac{u}{2}} \left[ \sin\frac{s\beta}{2} \sin\left(\frac{s+d}{2}\beta - \frac{u}{2}\right) - e^{-j(s+d+p)\beta + ju} \sin\frac{p\beta}{2} \sin\left(\frac{d+p}{2}\beta - \frac{u}{2}\right) \right] \quad (1a)$$

$$E_A(\theta) = \frac{-4E}{\sqrt{2}} je^{-j\frac{2s+d}{2}\beta + j\frac{u}{2}} \left[ \sin\frac{s\beta}{2} \cos\left(\frac{s+d}{2}\beta - \frac{u}{2}\right) + e^{-j(s+d+p)\beta + ju} \sin\frac{p\beta}{2} \cos\left(\frac{d+p}{2}\beta - \frac{u}{2}\right) \right] \quad (1b)$$

where E is the magnetic dipole strength, $E_T(\theta)$ is the transverse component of E (ie parallel to the x-y plane in FIG. 1) and $E_A(\theta)$ is the axial component of E (ie in the x-z plane and normal to $E_T$; thus for $\theta=90°$, $E_A$ is parallel to the array axis x, and for $\theta=0°$ $E_A$ is normal to the array axis x in the z direction), $u=-k_o d \cos\theta$, $\beta$ is the wave-number in the microstrip line ($\beta=2\pi/\lambda_m$ where $\lambda_m$ is the operating wavelength in the line), and $k_o$ is the wave-number in free space ($k_o=2\pi/\lambda_o$ where $\lambda_o$ is the free-space wavelength).

The polarization of the total field is given by the ratio of the above components, ie by $$\frac{E_T}{E_A} = -j\sin\theta \left[ \frac{\sin\frac{s\beta}{2} \sin\left(\frac{s+d}{2}\beta - \frac{u}{2}\right) - e^{-j(s+d+p)\beta + ju} \sin\frac{p\beta}{2} \sin\left(\frac{d+p}{2}\beta - \frac{u}{2}\right)}{\sin\frac{s\beta}{2} \cos\left(\frac{s+d}{2}\beta - \frac{u}{2}\right) + e^{-j(s+d+p)\beta + ju} \sin\frac{p\beta}{2} \cos\left(\frac{d+p}{2}\beta - \frac{u}{2}\right)} \right] \quad (2)$$

From equation (2) three particular cases can be derived.

Elliptical polarization, right-hand

This is obtained by making p=0 so that $$\frac{E_T}{E_A} = -j\sin\theta \tan\left(\frac{s+d}{2}\beta - \frac{u}{2}\right) \quad (3)$$

If $|E_T/E_A|=1$, right-hand circular polarization is obtained. In this case, for $\theta=90°$ (the broadside direction)

$$\frac{s+d}{2}\beta = (n+1)\frac{\pi}{4}, \text{ for } n = 0, 2, 4, \ldots \quad (4)$$

For $|E_T/E_A|\neq 1$, any ellipticity can be obtained. For $\theta\neq 90°$ equation (4) becomes $$\frac{s+d}{2}\beta - \frac{u}{2} = \tan^{-1}\left(\frac{1}{\sin\theta}\right) \quad (4a)$$

which has no such simple solution. It will be seen that for $\theta\neq 90°$, as $\theta$ changes the ellipticity also changes, and this limits the bandwidth obtainable for a given ellipticity.

Elliptical polarization, left-hand

This is obtained by making s=0 so that $$\frac{E_T}{E_A} = j\sin\theta \tan\left(\frac{d+p}{2}\beta - \frac{u}{2}\right) \quad (5)$$

In this case if $|E_T/E_A|=1$, left-hand circular polarization is obtained, and for $\theta=90°$ (the broadside direction)

$$\frac{d+p}{2}\beta = (n+1)\frac{\pi}{4} \text{ for } n = 0, 2, 4, \ldots \quad (5a)$$

Again for $|E_T/E_A|\neq 1$, any ellipticity can be obtained, and for $\theta\neq 90°$, equation (5a) becomes $$\frac{d+p}{2}\beta - \frac{u}{2} = \tan^{-1}\left(\frac{1}{\sin\theta}\right) \quad (5b)$$

Linear polarization

This is obtained by making p=s so that $$\frac{E_T}{E_A} = \sin\theta\tan\left(\frac{s+d}{2}\beta - \frac{u}{2}\right)\tan\left(\frac{2s+d}{2}\beta - \frac{u}{2}\right) \quad (6)$$

The orientation of the polarization is controlled by varying the arguments of the tan functions. Two important cases are:

Linear transverse polarization (ie vertical polarization (VP))

Here $E_A=0$, so that (assuming $\sin\theta\neq 0$)

$$\left.\begin{array}{ll}\text{either} & (2s+d)\beta - u = \pi(n+1) \quad (7)\\ \text{or} & (s+d)\beta - u = \pi(n+1) \quad (8)\end{array}\right\} \quad n = 0, 2, 4, \ldots$$

Linear axial polarization (ie horizontal polarization (HP))

Here $E_T=0$, so that $$\left.\begin{array}{ll}\text{either} & (2s+d)\beta - u = 2n\pi \quad (9)\\ \text{or} & (s+d)\beta - u = 2n\pi \quad (10)\end{array}\right\} \quad n = 1, 2, 3, \ldots$$

When $\sin\theta=0$, $E_T=0$, for any value of s or d.

In order to complete the definition of the array structure, the strip-length L between successive cells is required. For the first corner-source in each cell to be in phase in the direction $\theta$, it can be shown that $$L = \frac{2(s+p+d)\beta - 2m\pi - 2k_o d\cos\theta}{k_o\cos\theta - \beta} \quad (11)$$

where m is an integer giving the smallest $L\geqq 0$. (It will be apparent that the expression of equation (11) may optionally include a further term, $+n\lambda_m$, where n=1, 2, 3 . . . , without affecting the required phase relationships, but as a practical matter this gives no apparent advantage and may give rise to grating lobes).

It will now be shown that the above-described general six-cornered structure of FIG. 1 will reduce to the specific four-cornered structures described in the aforesaid application Ser. No. 55,259 which give vertical, horizontal or circular polarization in the broadside direction, ie for $\theta=90°$.

Circular polarization (CP) (right hand)

p=0 and $|E_T/E_A|=1$, so that from equation (4)

$$s + d = \frac{\lambda_m}{4}(n+1)$$

Putting n=2 and $d=\lambda_m/4$, then $s=\lambda_m/2$.

From equation (11) with m=2, then $L=\lambda_m/2$.

Figure 2:
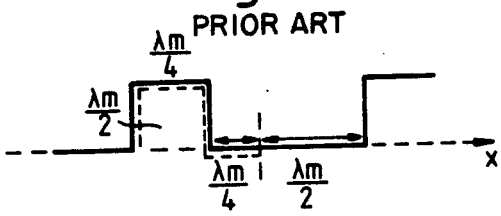
Fig.2. PRIOR ART
FIGS. 2, 3 and 4 are simplified plan views of cells of three prior-art arrays producing respectively circularly, vertically and horizontally polarized broadside radiation to illustrate their derivation from FIG. 1.
Figure 4:
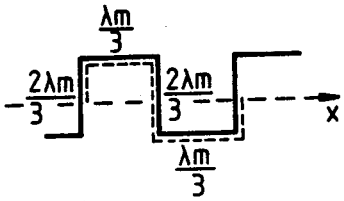
Fig.4. PRIOR ART

FIG. 1 thus reduces to FIG. 2 (extent of single cell shown dashed), which corresponds to FIG. 4 of the application Ser. No. 55,259.

(For left-hand circular polarization s=0 so that the $\lambda_m/2$ sections extend below the x axis of the array).

Linear polarization (VP)

p=s and $E_A=0$, so that from equation (7)

$$(2s+d) = \frac{\lambda_m}{2}(n+1)$$

Putting n=o and $d=\lambda_m/4$, then $s=p=\lambda_m/8$.

From equation (11) with m=1, then L=0.

Figure 3:
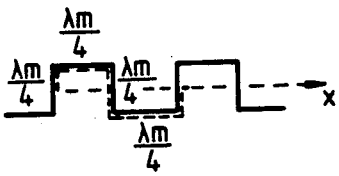
Fig.3. PRIOR ART

FIG. 1 thus reduces to FIG. 3, which corresponds to FIG. 2 of the application Ser. No. 55,259. (The extent of each single cell in the present FIG. 3 (shown dashed) is defined differently from in the aforesaid FIG. 2 for clarity, but the resulting array structures are identical.)

Linear polarization (HP)

p=s and $E_T=0$, so that from equation (9)

$$(2s+d)=n\lambda_m$$

Putting n=1 and $d=\lambda_m/3$, then $s=p=\lambda_m/3$.

From equation (1) with m=2, L=0.

FIG. 1 thus reduces to FIG. 4, which corresponds to FIG. 3 of the application Ser. No. 55,259. (The above comment about defining the extent of each cell applies here also, and less markedly to present FIG. 2.)

The above three specific structures already described in application Ser. No. 55,259 are excluded from the scope of the present invention.

Arbitrary elliptical polarization

Arbitrary elliptical polarization is obtained by putting $E_T/E_A=jE$, where E is the ellipticity, into equation (3). Thus for the broadside direction ($\theta=90°$)

$$E = \tan\frac{s+d}{2}\beta \quad (12)$$

Figure 5:
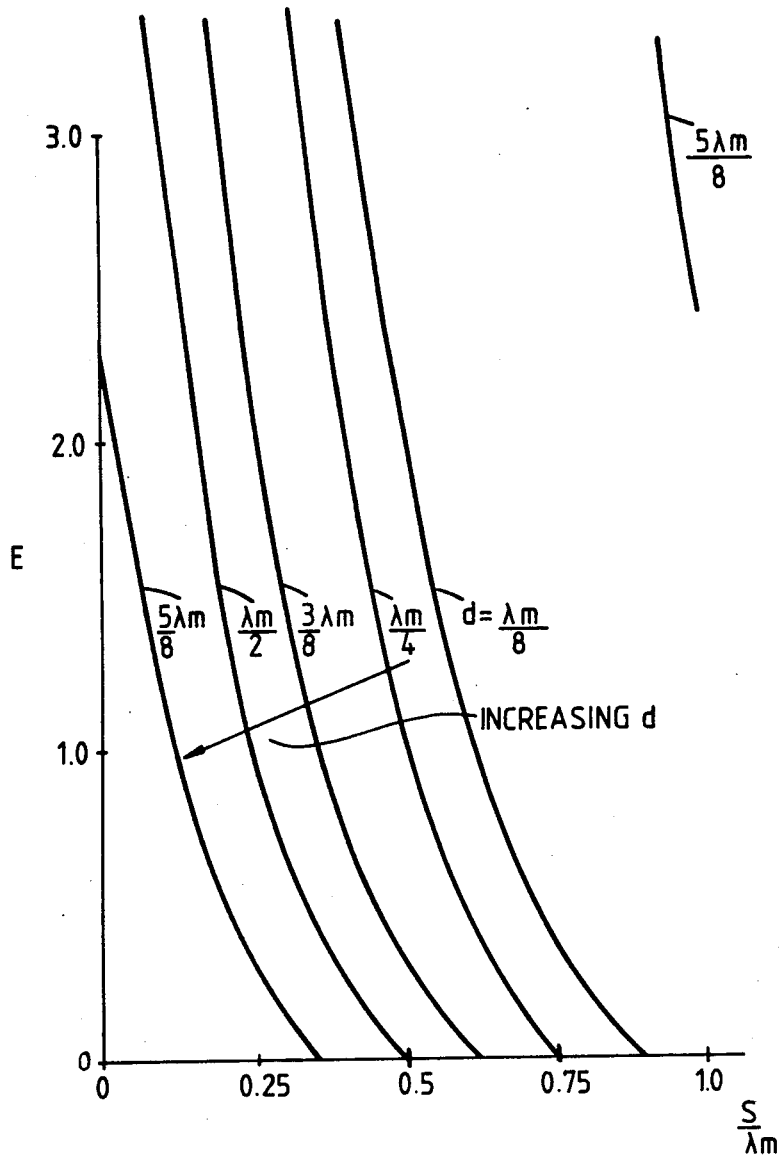
FIG. 5 is a family of curves relating E to s for various values of d (as hereinafter defined).

For a given d, equation (12) allows E to be selected by appropriate choice of s. The major axis of the polarization ellipse lies along the direction of either $E_A$ or $E_T$, depending the value of E. Curves of E against s for various values of d are plotted in FIG. 5.

Arbitrary linear polarization

Figure 6:
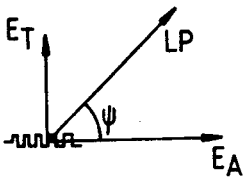
FIG. 6 shows the derivation of an angle $\psi$ (as hereinafter defined).

From equation (6) putting $\theta=90°$ and $E_T/E_A=\tan\psi$, then $$\tan\psi = \tan\left(\frac{s+d}{2}\beta\right)\tan\left(\frac{2s+d}{2}\beta\right) \quad (13)$$

where $\psi$ is defined in FIG. 6, in which LP indicates the linear polarization direction (of the broadside radiation) parallel to the plane (x-y) of the array (indicated at the origin of the Figure).

Equation (13) can be solved numerically, and some values of $d/\lambda_m$ for given values of $s/\lambda_m$ and $\psi$ are given in the following Table:

| | $s/\lambda_m$ | | | | |
|---|---|---|---|---|---|
| $\psi$(deg) | 0.3 | 0.25 | 0.1 | 0.07 | 0.03 |
| 0 | 0.30 | 0.50 | 0.66 | 0.85 | 0.94 |
| 30 | 0.26 | 0.40 | 0.56 | 0.68 | 0.74 |
| 60 | 0.23 | 0.34 | 0.46 | 0.60 | 0.66 |

-continued

| ψ(deg) | $s/\lambda_m$ 0.3 | 0.25 | 0.1 | 0.07 | 0.03 |
|---|---|---|---|---|---|
| 90 | 0.16 | 0.25 | 0.30 | 0.43 | 0.47 |

FIGS. 7(*a*)–(*o*) show some typical structures, drawn to the same scale, derived from equation (13) and by putting m=2 in equation (11). (This value of m has not necessarily optimized the structure in all cases). Each Figure shows three successive cells, although in practice an array will have many more than three cells, eg ten. In FIGS. 7(*a*)–(*j*) each cell has six actual corners; in FIGS. 7(*k*)–(*o*) these reduce to four actual corners because the inter-cell strip-length reduces to zero.

The distribution of power radiated across the aperture constituted by the array can be varied in the manner described in the aforementioned U.S. application Ser. No. 55,259 with reference to FIG. 5 thereof, ie by making the strip-width increase progressively towards the center so that more power is radiated from the center. Alternatively, this effect can be obtained in the manner described in copending U.S. patent application Ser. No. 351,097 of even date and identical title by the present applicants in which the cell dimensions are varied progressively towards the center.

One array embodying the invention is shown in silhouette in FIG. 8, in which the power distribution across the aperture is controlled by increasing the strip-width towards the center. The aim was an HP array giving the coverage in the $\theta$ plane indicated in FIG. 9, having low side-lobes in the region $120° < \theta < 180°$. In order to suppress cross-polarized grating lobes, d is kept small; here 2s/d=3 and hence $2s=0.56\ \lambda_m$ from equation (9) with n=1 and $\theta=0$. Although the use of equation (9) (and similarly (10)) is not strictly necessary to give $E_T=0$ at $\theta=0$, its use will ensure $E_T \approx 0$ for small values of $\theta$. The strip-width and correction to account for the corner susceptance are determined empirically. The position of the coaxial output connector 14 and the match thereto are important in this embodiment, as unwanted radiation from the connector, and the reflected wave created by any mismatch, are found to limit the achievable side-lobe level. FIG. 8 shows the optimum connector position.

Versions of this embodiment having ten cells (as shown in FIG. 8), twenty cells and thirty cells respectively gave reduced side-lobe levels as the array length, and hence the peak gain, was increased, as shown in the Table below:

| No of Cells | Array length ($\lambda_o$) | Measured side-lobe level (dB) $120° < \theta < 180°$ |
|---|---|---|
| 10 (FIG. 8) | 3.1 | −15.0 |
| 20 | 6.2 | −16.0 |
| 30 | 9.3 | −21.0 |

FIG. 10 shows the actual coverage in the $\theta$ plane obtained with the ten-cell version (FIG. 8), which may be compared with the desired coverage shown in FIG. 9.

It will be appreciated that, although described in relation to their use as transmitting arrays, the present antennas can, as normal, also be used for receiving."

In the present invention it is assumed that the power radiated over all space by each cell of the array is proportional to the power which it radiates in the main beam direction. This assumption assumes in turn that the radiation pattern of a cell does not change with changes in the absolute lengths of the sections, provided the relationships between them specified in copending application Ser. No. 351,097 are retained. As both the longitudinal and transverse dimensions of the cells are in practice comparable to a wavelength, some pattern changes are inevitable. However, by using a substrate of high dielectric constant, all the changes in length are reduced, and it is found in practice that the above assumption of a constant radiation pattern gives acceptable results for most purposes.

On the above assumptions, the total power, $P_T$, radiated by each cell of the array, assuming that the main beam is in the $\theta$ plane, is given by $$P_T = cP(\theta) = c[|E_T(\theta)|^2 + |E_A(\theta)|^2] \tag{14}$$

where c is an arbitrary constant, the $\theta$ plane is normal to, and includes, the axis of the array, and $E_T$ and $E_A$ are respectively the transverse and axial components of magnetic dipole strength (directions defined in application Ser. No. 351,097) for a given cell.

It can be shown by using equation (1) of application Ser. No. 351,097, and putting therein the conditions for circular, vertical and horizontal polarization from equations (4) or (5), (7) or (8) and (9) or (10) respectively of that application, that For circular polarization (CP)

$$P_T = 8cE^2\sin^2\frac{s\beta}{2} \tag{15}$$

(Equation (15) applies only when the main beam is in the broadside direction ($\theta=90°$).

For vertical polarization (VP) and horizontal polarization (HP)

$$P_T = 8cE^2\sin^2\frac{s\beta}{2}\cos^2\frac{s\beta}{2} \tag{16}$$

(Equation (16) applies only for $\sin\theta \neq 0$).

In equations (15) and (16), E is the magnetic dipole strength, s is the length of the transverse strip section either side of the array axis and $\beta$ is the wave-number in the stripline, as more fully explained in the application Ser. No. 351,097.

Similar, though more complicated, expressions exist for arbitrary polarization directions, the latter directions being discussed in application Ser. No. 351,097.

Knowing the required power distribution across the effective radiating aperture, ie the respective powers from successive cells along the array, the particular value of $P_T$ required from each cell is inserted separately in equations (15) or (16) above to determine $s/\lambda_m$ for each cell. $cE^2$ in equations (15) or (16) can be determined by measurement, eg by measuring the power radiated by an array of identical cells and dividing by the number of cells in that array. Thereafter equations (4), (8) and (10) in application Ser. No. 351,097 allow $d/\lambda_m$ to be determined for each cell, and equation (11) therein gives L, where d is the length of the longitudinal strip sections in each cell and L is the strip-length between successive cells.

A plan view, drawn to scale, of an array embodying the present invention is shown in FIG. 11 of the accompanying drawing. This array comprises twenty cells and gave the following results.

| | |
|---|---|
| Beamwidth | 10 deg |
| Squint | 30° off normal (ie $\theta$ = 60°) |
| Sidelobe level | −22 dB |
| Frequency | 17.0 GHz |
| polarization | HP |
| Substrate | $\epsilon_r$ = 9.8 h = 0.5 mm |
| $s_{max}$ | $0.05\lambda_m$ |

With reference to FIG. 7 of application Ser. No. 351,097, it may be seen that the above array corresponds to the smaller values of $s/\lambda_m$ for $\psi=0°$, ie it approximates to FIGS. 7(*k*) and (*l*), where d>2s.

It will be appreciated that, although described in relation to their use as transmitting arrays, the present antennas can, as normal, also be used for receiving.

We claim:

1. A strip-line array having a longitudinal axis and comprising:

a strip of conducting material on an insulating substrate having a conducting backing;

said strip turning through successive right-angle corners to form a plurality of cells each defined mathematically by the lengths, in relation to the operating wavelength in the strip, of:

three equispaced transverse sections (a) extending at right angles from said axis, the central transverse section extending both sides of said axis; and two longitudinal sections (b) connecting the outward extremities of said transverse sections; said strip also including:

a longitudinal section (c) between successive cells;

the lengths of the transverse sections (a) on either one side only of the axis having a value in the range from zero upwards, and the length of the longitudinal section (c) also having a value in the range from zero upwards, whereby each cell has either four or six of said corners depending upon said values;

the lengths of the transverse sections (a), of the longitudinal sections (b) and the longitudinal section (c) being such that when connected to a source of the operating frequency and operated in a travelling-wave mode, the summed radiation from the right-angle corners in each cell has the same polarization direction at a given angle to said array axis in a longitudinal plane normal to the array plane and containing said array axis; and the lengths of the transverse sections (a) and the longitudinal sections (b) in each separate cell differing, as between cells, in such manner as to produce a required non-uniform power distribution across the aperture constituted by the array.

2. An array as claimed in claim 1 wherein said lengths increase progressively towards the center of the array, thereby to effect a similar increase in the power distribution.

3. An array as claimed in claim 1 or claim 2 wherein the lengths of the transverse sections, as between cells, satisfy the equation:

$$P_T = 8cE^2\sin^2\frac{s\beta}{2}$$

or the equation:

$$P_T = 8cE^2\sin^2\frac{s\beta}{2}\cos^2\frac{s\beta}{2}$$

in relation to the required power distribution, where

PT is the total power radiated from each cell, c is an arbitrary constant,

E is the magnetic dipole strength, s is the length of the transverse strip section (a) either side of the array axis, and $\beta=2\pi/\lambda_m$ is the operating wavelength in the strip.

* * * * *